United States Patent [19]

Whellams

[11] Patent Number: 4,620,571

[45] Date of Patent: Nov. 4, 1986

[54] SKEINING APPARATUS

[75] Inventor: Geoffrey E. Whellams, Teeside Airport, Great Britain

[73] Assignee: Fisher-Baker Corporation, Jensen Beach, Fla.

[21] Appl. No.: 633,845

[22] Filed: Jul. 24, 1984

[51] Int. Cl.[4] ..... B65H 54/56

[52] U.S. Cl. ..... 140/102; 28/291; 242/53

[58] Field of Search ..... 28/291; 140/102, 104, 140/149, 92.1, 71 R; 242/53

[56] References Cited

U.S. PATENT DOCUMENTS

| | | | |
|---|---|---|---|
| 13,267 | 7/1855 | Kelsea . | |
| 13,562 | 9/1855 | Swift . | |
| 978,657 | 12/1910 | Schloss et al. . | |
| 1,948,460 | 2/1934 | Hamburger et al. . | |
| 2,246,608 | 6/1941 | Taylor et al. | 28/291 |
| 2,581,142 | 1/1952 | Rea . | |
| 2,615,654 | 10/1952 | Suggs . | |
| 2,618,445 | 11/1952 | Buder . | |
| 2,670,589 | 3/1954 | Bates . | |
| 2,694,419 | 11/1954 | Larsen . | |
| 2,907,535 | 10/1959 | Mindheim et al. . | |
| 2,981,498 | 4/1961 | Yuryan . | |
| 3,001,946 | 9/1961 | Jentschmann . | |
| 3,062,480 | 11/1962 | Suggs . | |
| 3,146,968 | 9/1964 | Baud . | |
| 3,151,437 | 10/1964 | Schlein . | |
| 3,351,296 | 11/1967 | Frei . | |
| 3,362,440 | 1/1968 | Meile et al. . | |
| 3,578,256 | 5/1971 | Vermeulen . | |
| 3,750,720 | 8/1973 | Steigerwald . | |
| 3,827,465 | 8/1974 | Loy et al. . | |
| 3,831,361 | 8/1974 | Ullmann . | |
| 4,129,158 | 12/1978 | Schmid . | |
| 4,132,250 | 1/1979 | Brown et al. . | |
| 4,207,927 | 6/1980 | Camardella . | |
| 4,393,344 | 7/1983 | Whellams . | |
| 4,449,355 | 5/1984 | Moore et al. . | |
| 4,511,094 | 4/1985 | Kent | 242/53 |

FOREIGN PATENT DOCUMENTS

| | | | |
|---|---|---|---|
| 2213917 | 9/1973 | Fed. Rep. of Germany | 242/53 |
| 631956 | 11/1949 | United Kingdom . | |
| 880913 | 10/1961 | United Kingdom . | |
| 961553 | 6/1964 | United Kingdom . | |
| 1429271 | 3/1976 | United Kingdom . | |
| 1469071 | 3/1977 | United Kingdom . | |
| 2049748A | 12/1980 | United Kingdom . | |
| 2093382A | 9/1982 | United Kingdom . | |

OTHER PUBLICATIONS

Advertisements of Fisher Industries and HCW.
Sales brochure, Rotawinder.
Sales brochure, Meteor AG (undated).

*Primary Examiner*—Lowell A. Larson
*Attorney, Agent, or Firm*—Burton, Parker & Schramm

[57] ABSTRACT

Method and apparatus for forming a twisted skein in a filament for use in a coil winding machine without severing the filament. The apparatus is provided with a pair of spaced apart filament guides between which are located looping needles about which the filament is wound by a looping element carried by an endless drive member. When the required numbers of loops have been formed about the needles, one needle is rotated, causing the loops to be formed into a skein. An electromagnet wire tensioner and a closed loop automatic wire tensioning system are also described.

28 Claims, 33 Drawing Figures

FINGER RETURN RUN PRIOR TO WIRE DROP RELEASE

WIRE RELEASED - LOOP COMPLETE

SKEINING APPARATUS

FIELD OF INVENTION

This invention relates to skeining apparatus—that is to say, apparatus arranged to operate on a filament so as to form a twisted skein therein, intermediate the ends of the filament but without severing the filament. Though the apparatus of this invention is intended for use with a metallic monofilament—i.e. wire—it may in fact be used with certain multi-stranded wires, or with certain filaments made of materials other than metals.

BACKGROUND OF INVENTION

Though it may be required to form a skein in a filament for any of a variety of reasons, most commonly it is desirable when starting or terminating the winding a coil from wire of relatively fine gauge, or when providing a tapping part-way through a coil-winding operation. Such skeining is necessary because relatively fine wire has a very low strength and a single strand of fine copper is likely to fracture when subjected to the flexing and soldering operations necessary to terminate the coil or to provide a tapping.

Conventionally, a skein has been formed manually, by an operator folding a continuous length of the wire successively to provide several strands side-by-side and then twisting the strands axially, by rolling them between the fingers. This however requires considerable manual dexterity, and even with a skilled and experienced operator wire breakages can still easily occur. Moreover, such a manual operation makes the winding of a coil labour-intensive, and hence expensive.

In view of the disadvantages of forming skeins manually, there have been certain proposals for automatic skeining apparatus, and to some extent practical embodiments of these have helped to reduce the cost of coil-winding. A typical example of such an apparatus is shown in U.K. Patent Applications GB 2049748A and 2093382A. These machines have a flying shuttle with an eyelet through which the wire is threaded and when a skein is to be formed, the eyelet carries the wire round two spaced pins. One pin is then rotated with respect to the other, twisting the loops formed around the pins into a skein. Rather than rotating one of the pins about which the wire is looped, the loops once formed may be twisted by a twisting unit which engages the loops between the pins as shown in U.S. Pat. Nos. 4,129,158 and 4,207,927. The accurate guiding of the shuttle has caused considerable problems, especially when very fine wire is being skeined—such as copper monofilaments of a diameter as small as 0.025 mm (0.001 in)—and rapid rates of wear and high strains can occur when the apparatus is operated relatively quickly. Moreover, in view of the capital cost and size of the known skeiners of this type, it is usual to construct them so as to be suitable for the simultaneous skeining of two filaments running side-by-side. However, because a breakage of one filament almost always results in the second filament breaking, it is then necessary to run the skeiner even yet slower, so as to reduce the likelihood of a breakage even more. In addition, to reduce the probability of a malfunction of the shuttle, it has been necessary to provide complex and highly accurate mechanisms to ensure the wire is carried round the pins safely without breakages, but in turn this both decreases the reliability of the apparatus and increases the capital cost thereof.

SUMMARY OF INVENTION

This invention has as a primary object the provision of skeining apparatus which is simplified as compared with the known form of skeining apparatus described above, and which therefore has a lower capital cost and greater reliability.

Accordingly, this invention provides skeining apparatus for skeining a filament, comprising first and second skeining needles spaced apart and disposed to allow the filament to be looped therearound. The first skeining needle being mounted on a rotatable spinner, the axis of rotation of which is generally co-incident with a line passing through the two needles. The apparatus is provided with an endless flexible tension member carrying at least one filament looping element constrained to follow such a path that on driving the tension member around said path the locus of the looping element encircles the two needles with at least one of the needles intersecting the plane of the locus. Two spaced filament guides are disposed to support a filament to be skeined adjacent the skeining needles. The apparatus is provided with drive means for the flexible tension member and for the spinner, whereby driving the flexible tension member causes the looping element to loop a filament extending between the filament guides around the skeining needles. After stopping the flexible tension member, rotating the spinner causes the looped filament to be twisted along the length of the loops, thereby to form the skein.

Most advantageously, the skeining apparatus of this invention is employed in a coil-winding installation, the apparatus being disposed between a reel of wire to be di-reeled prior to being wound into a coil and the coil-winder itself, with the wire running through the filament guides of the apparatus throughout a coil-winding operation. Before the winding commences, the skeining apparatus should be operated to form a skein in the wire which will form the start of the coil, and the apparatus should again be operated at the end of the winding, immediately before the last few turns (or part-turn in the case of large diameter coil) are wound on the coil. Of course if the coil is to have one or more tappings, then the winding operation should be stopped after an appropriate number of turns have been wound, the skeining apparatus operated, and then the winding operation recommenced but with the thus-formed skein doubled along its length and left loose to project out of the finished coil.

In a particularly preferred form of this apparatus, the looping element makes no contact with the filament other than when the loops are being formed around the skeining needles, the looping element being in the form of a finger attached to the flexible tension member so as to upstand from the plane of the path around which the flexible tension member is driven, whereby the locus of the finger is parallel to the plane of the flexible tension member path. Consequently, only a relatively small drag is imparted to the filament on being drawn through the skeining apparatus other than when a skein is being formed, and the likelihood of a breakage is much reduced. If required, two fingers may be provided on the flexible tension member so as to form two loops for each complete revolution of the flexible tension member.

This preferred form of the apparatus is especially suitable for incorporation in a complete coil-winding installation, for a single looping element together with the associated flexible tension member and drive arrangement may be provided to service a plurality of separate coil-winding mechanisms, each having first and second skeining needles and two spaced filament guides. For such an installation, the looping mechanism may be moved relative to each coil-winding mechanism to service each one in turn, as appropriate. Most conveniently, all of the coil-winding mechanisms may be mounted on a carousel to be advanced through a plurality of stations on rotation thereof, one of the stations having located thereat the looping mechanism such that a skein may be formed in the filament of the coil-winding mechanism positioned for the time being at the looping station.

An alternative form of the apparatus may have the looping element formed as a filament guide carried by the flexible tension member and through which the filament passes, but for such an embodiment it is important that the looping element should always be stopped at a predetermined position in its locus when skeining is not to take place, in order that the filament does not touch the skeining needles and follows a relatively low drag path when being drawn through the apparatus—for instance to wind a coil. In this embodiment, the looping element may for example comprise a ceramic bead, or hard eyelet mounted on a ridge support attached to the flexible tension member.

For precision in operation, it is preferred for the flexible tension element to be a roller chain or a toothed belt, constrained by at least two co-planar spaced sprockets to define two parallel elongate runs between the sprockets, the runs being generally parallel to a line passing through the two skeining needles. Further supports for the chain or belt may be provided as necessary to ensure the chain or belt follows a substantially planar path, which further guides may comprise for instance sprockets, rollers or slippers, as required. Moreover, one of the two principal sprockets may be replaced by a roller or even a fixed arcuate slipper, but of course one sprocket still must be provided in order to allow drive to be imparted to the chain or belt.

When the flexible tension member is a chain, it is preferred for the looping element (irrespective of the design thereof) to be attached to or to form (in part) one of the side plates of the chain. However, it would be possible for the looping element itself to constitute a special link of the chain, with two ends of the chain proper being joined thereto, thus to define the endless tension member.

For the arrangement where the looping element is formed as a filament guide through which the filament runs— which arrangement is suitable for servicing only a single coil-winding mechanism—it is necessary to prevent the filament becoming wound around the filament guide on driving the flexible tension member. This may be done by providing an aperture centrally of the constraint means at the end of the two runs of the chain remote from the spinner, which aperture is formed as one of the two main filament guides, the filament then passing in sequence through the filament guide aperture, the looping element filament guide and then the other filament guide. Conveniently, the constraint means defining the filament guide aperture is in the form of a fixed slipper (rather than a sprocket) having an arcuate guide surface around which the flexible tension element passes, in order to avoid complications which would arise if a sprocket has to be rotatably mounted.

The first skeining needle mounted on the rotatable spinner is preferably provided at the free end of an arm which projects from the spinner generally parallel to the axis of rotation thereof, towards the second skeining needle. The spinner convenienty is in the form of a hollow body carried in bearings allowing the free rotation thereof, the arm projecting from an end face of the body. If required, the arm may be inclined to some extent towards the spinner axis from the point at which the arm is connected to the body, but the arm should not cross said axis. For such an arrangement, the skeining needle should extend from the free end of the arm across the axis of rotation of the spinner, preferably inclined back towards the spinner body so as to assist the retention of loops of the filament thereon, but to allow free release of the formed skein on movement of the filament through the spinner body after the skein has been released from the second needle.

An alternative form of spinner construction has a tube suitably mounted in bearings so as to project towards the second skeining needle; a part of the tube wall is cut away from the free end of the tube for at least a part of the projecting portion of the tube so as to leave an arcuate wall projecting towards the second needle in which wall the first needle is mounted. Conveniently, this is achieved by appropriately positioning the needle with respect to the wall adjacent the free end thereof and then deforming the free end portion so as firmly to clamp the needle. Instead, a drilling could be provided through the wall to receive the needle, which would then be held either by being an interference fit, or by being clamped for instance by means of an appropriately-positioned grub screw.

This invention extends to such an alternative form of spinner/first needle assembly, per se.

The second skeining needle, remote from the spinner, should be fixed against rotation about an axis parallel to or coincident with a line passing through the two needles, but the second needle preferably is mounted to allow movement thereof towards and away from the spinner (first) needle. This allows accommodation of the shortening length of the loops of filament as twisting of those loops to form the skein takes place, which shortening would ortherwise have to be absorbed either by stretching of he filament or by deformation of the needles. The second skeining needle advantageously is inclined in the opposite sense to the first needle—at least prior to twisting commencing—to assist the retention of loops of filament thereon.

A particularly prefered arrangement for the second skeining needle is to have the needle projecting from a carrier which is pivotally mounted to allow the needle to swing towards and away from the spinner first needle, biassing means being provided to urge the carrier such that the free end of the needle tends to move away from the spinner needle. Such biassing means may simply comprise a spring, in which case the force exerted thereby advantageously is adjustable by pre-loading the spring, but a preferred embodiment of the apparatus employs a biassing means which utilises an electric motor or other electric actuator arranged to apply a torque to the carrier the magnitude of which torque depends upon the voltage impressed across the motor or actuator terminals and hence upon the power dissipated within the motor or actuator.

It would be possible to continue the twisting action performed by the spinner until such time as the skein drops off the second needle, by virtue of the shortening of the loops causing the second needle to swing towards the spinner needle until the second needle has swung to such an extent that the loops can no longer be retained thereby. However, it may be wished to terminate the twisting before the second needle has swung to that extent, so the carrier for the second needle conveniently is arranged to allow the second needle to be withdrawn into the carrier, the carrier thus pushing the loops off the second needle.

Accordingly, a preferred arrangement for a second needle assembly comprises a carrier pivotally mounted for swinging movement towards and away from the spinner needle, a needle mounted on a toothed rack slidably supported on the carrier for movement along its length between a first position in which the needle is housed within the carrier and a second position in which the needle projects from the carrier, the rack extending past the pivotal axis of the carrier and being engaged by a pinion rotatable about said axis, and an electric actuator provided on a fixed part of the apparatus and arranged to drive the pinion, the arrangement being such that torque exerted by the actuator in one sense causes the pinion to rotate to drive the rack to its second position and thereafter urges the carrier to swing about its pivotal axis in a direction which moves the projected needle away from the spinner needle, and torque exerted by the actuator in the other sense allows the carrier to swing towards the spinner needle and also withdraws the needle back into the carrier.

This invention extends to a second needle assembly per se for a skeining machine including a spinner needle, wherein the second needle assembly is of the form just-described above.

In addition to the second needle being able to pivot, to accommodate the shortening of the loops of the filament as the twisting thereof takes place, it is preferred for the second needle (or its carrier, as appropriate) to be mounted for adjusting movement towards and away from the spinner (first) needle, without changing the angle of inclination of the second needle. In this way, the distance between the two needles can be pre-set, so that the length of the skein formed by the apparatus can be selected to a suitable value.

The drive means employed in the skeining apparatus of this invention preferably utilises a single electric motor, sequentially to operate the flexible tension member and the spinner. Such a configuration is of course not possible where a single looping mechanism services a plurality of coil-winding mechanisms, but where a single motor can be employed, it is convenient for there to be two drive trains from the electric motor, one leading to the drive member for the flexible tension member and the other leading to the spinner, and there being clutch asemblies in the two drive trains, allowing independent operation of each of the flexible tension member and the spinner. Preferably, each clutch assembly is electromagnetically controlled and is provided with a detent mechanism which assures the movement of the associated tension member of a spinner is arrested at the same relative disposition each time the associated clutch disconnects the drive from the motor. Conveniently, so-called "spring-clutches" can be employed for this purpose.

It will be appreciated that as the looping element performs its locus around the two skeining needles so as to form loops therearound, filament will be drawn from a source thereof—for example, a reel—and the rate at which the filament is drawn will depend upon the part of the locus along which the looping element is moving. As a consequence of this, it is necessary for particular attention to be paid to proper tensioning of the filament if breakages are to be avoided, especially when handling relatively thin filaments such as fine copper wire used in winding coils. Conventional tensioning means may be found not to be wholly suitable, because very often the actual drag imparted on a filament by such means depends upon a variety of factors, but particularly upon the speed at which the filament passes through the tensioning means. Accordingly, it is greatly preferred for the skeining apparatus of this invention to be provided with self-adjusting tensioning means arranged between the source of the filament and the looping element, and which provides a substantially constant tension (or drag) on a filament being drawn there-through, irrespective of the filament speed. There are known self-adjusting tensioning means, but these tend to be unsuitable for use in the apparatus of this invention when skeining very fine copper wire (perhaps down to 0.001 inch [0.025 mm] diameter) owing to a too low response time to change in the filament speed, and too high inertia in the moving parts. This has necessitated designing new forms of self-adjusting tensioning means, for use with the apparatus of this invention.

Thus, according to another aspect of this invention, there is provided self-adjusting filament tensioning means, comprising adjustable tensioning means through which the filament passes, adjusting means to effect adjustment of the tensioning means, means to monitor the tension in the filament and to condition an electrical signal dependent thereon, and electronic control means acting on the conditioned electrical signal and arranged to effect operation of the adjusting means dependent thereon.

There are many possible designs for suitable adjustable tensioning means which lend themselves to automatic control. For example said means may comprise a fixed first series of aligned filament guides through which the filament passes, and a second series of guides through which the filament also passes, the guides of the second series being arranged alternately with the guides of the first series, and all the guides of the second series being arranged for movement either in unison or individually away from or towards the common axis of the first series of guides. An electric motor or other actuator may be provided for each guide of the second series, or a single electric motor or other actuator may be provided where all the guides of the second series are movable in unison, thereby to effect adjustment of one or more of the guides of the second series with respect to the first series, thus to cause the filament to follow a zig-zag path to a greater or lesser extent hence varying the drag imparted on the filament.

In order to allow monitoring of the tension in a filament, it is preferred for the monitoring means to comprise two filament guides which are generally aligned, and a third guide mounted at the end of a pivoted arm biassed to move the third guide out of alignment with the other two guides, a filament passing sequence through the guides so that it is constrained to follow a generally V-shaped path. Then, by monitoring the angle the arm makes with respect to a reference position, the tension in the filament can be assessed, because greater tensions will tend to move the third guide nearer a position where the third guide is aligned with the other two guides.

BRIEF DESCRIPTION OF THE PREFERRED EMBODIMENT

Figure 1:
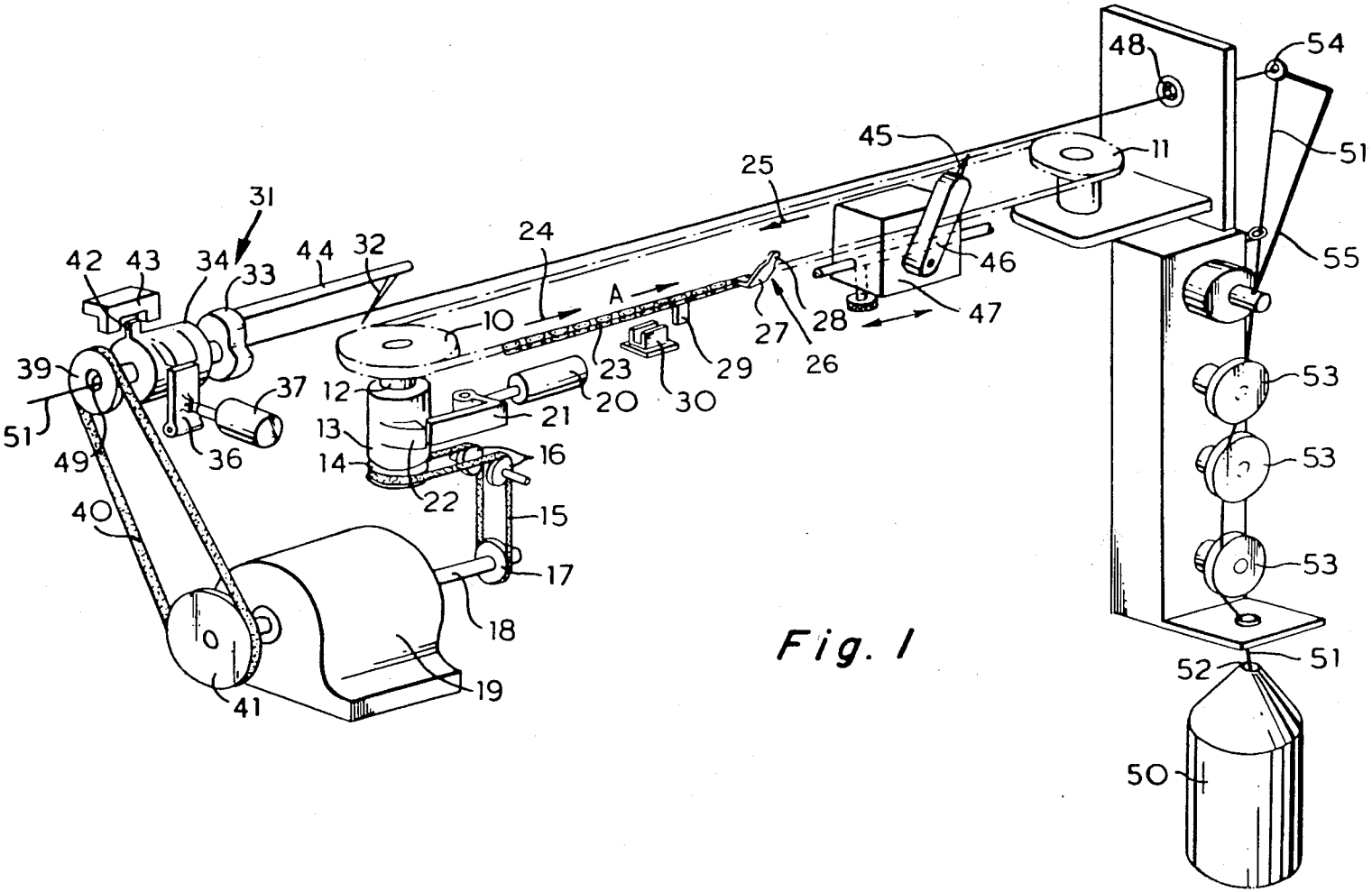
FIG. 1 is a diagrammatic general perspective view of a first embodiment of the skeining apparatus, employing a finger-looping element.

Referring initially to FIG. 1, the apparatus there shown is intended for skeining insulated copper monofilament wire such as is used in winding various types of coils. Though the apparatus may be used with wire of relatively heavy gauges, it is in fact primarily intended for use with wire of relatively fine gauges, down to 0.025 mm (0.001 inch diameter).

The apparatus shown in FIG. 1 comprises a pair of sprockets 10 and 11 suitably mounted on a frame (not shown) such that the sprockets are spaced apart with their axes parallel and generally vertical. Sprocket 11 is allowed to idle, whereas sprocket 10 is secured to a drive shaft 12 which also carries a so-called spring clutch 13. The input to the spring clutch 13 is through a pulley 14, connected by means of a belt 15 running over idling pulleys 16 to a driving pulley 17 mounted on a shaft 18 of an electric motor 19. The spring clutch 13 can be actuated by means of an electromagnet 20 coupled to a pawl 21 so as to allow the free end of the pawl 21 to be moved into or out of engagement with a dog 22 provided on the rotatable outer case of the spring clutch 13. With the electromagnet de-energized, the free end of the pawl 21 engages the dog 22 to prevent rotation of the spring clutch 13, and drive cannot therefore be imparted from the pulley 14 to the sprocket 10; energization of the electromagnet 20 however removes the pawl 21 from its engagement with the dog 22 so as to allow drive to be imparted from the pulley 14 to the sprocket 10. Moreover, the interengagement of the dog 22 and the pawl 21 ensures that the sprocket 10 is always arrested at the same angular disposition.

An endless drive member such as a roller chain 23 extends around the two sprockets 10 and 11, the chain defining linear runs 24 and 25 between the two sprockets 10 and 11. Attached to one side-plate on the upper side of the chain 23 is a skein looping element 26, comprising a mounting block 27 and a finger 28 projecting therefrom at an acute angle to the direction of movement of the chain along run 24, as shown by an arrow A. Projecting from the lower face of the chain is peg 29 which peg is able to co-operate with a slotted optical or inductive sensing element 30, to give an electrical output each time the peg 29 passes through the slot of the element 30.

A spinner assembly 31 is rotatably mounted adjacent the sprocket 10, and is generally parallel to and spaced from a plane through sprockets 10 and 11 the assembly supports spinner needle 32. The spinner assembly comprises a body 33 rotatably mounted with its axis substantially horizontal and in the plane also containing the axes of the sprockets 10 and 11, the body 33 being connected to the casing 34 of a second spring clutch generally similar to the spring clutch 13 described above. Thus, the casing has a dog 35 formed thereon co-operable with a pawl 36, the pawl being operable by an electromagnet 37 to come into and out of engagement with the dog 35. The input to the second spring clutch is through a pulley 39, coupled by means of a belt 40 to a driving pulley 41 also mounted on the shaft 18 of the electric motor 19, but at the opposite end thereof to the pulley 17. The casing 34 of the second spring clutch is provided with a peg 42 co-operable with a slotted optical or inductive sensing element 43, so as to allow electronic counting of the number of turns performed by the casing 34 and hence of the body 33.

Figure 2A:
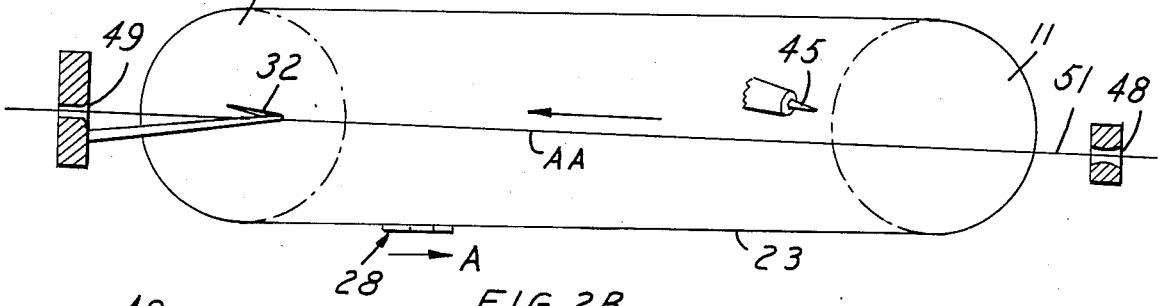
FIGS. 2A–2Q are top and sign elevations showing the relationship between the two pins, the finger-type looping element, and the wire at various stages of operation.

The body 33 supports an arm 44 which projects generally axially of the body 33, away from the second spring cutch. The arm is however inclined towards (but does not cross) the axis of the body 33 and the arm supports adjacent its free end the spinner needle 32, arranged both so as to cross the axis of the body 33 (and the filament axis AA as shown in FIG. 2A) and to project back towards the body 33, generally as shown in FIG. 1.

Adjacent the sprocket 11, there is provided a second needle assembly including a second needle 45, projecting from a direction generally opposite the first needle and between the runs 24 and 25 of the chain 23. The second needle 45 is mounted on a carrier 46 pivotally attached to a plate 47, a spring being provided to bias the carrier 46 such that the second needle 45 normally is inclined upwardly and towards the sprocket 11, but so that the second needle 45 and the carrier 46 may pivot against the spring bias back towards the sprocket 10. The plate 47 is slidably mounted between the runs 24 and 25 of the chain, and is securable at any desired position to allow setting of the spacing between the spinner needle 32 and the second needle 45 which in turn determines the length of the skein.

Adjacent the sprocket 11, there is provided a first wire guide 48, in the form of a ceramic eyelet. A bore 49 is provided right through the spinner assembly 31, such that the bore 49 may serve as a second wire guide. The mouth of the bore in body 33 may be provided with a bell-shape, and to assist the prevention of wear a ceramic lining may be provided to that mouth.

Wire 51 to be wound into a coil and also to be skeined by the apparatus of this invention, when appropriate, is drawn from a reel contained within the casing 50 of a de-reeling device, the wire 51 leaving the casing through a central upper aperture 52. The wire then passes through three disc tensoiners 53 which serve as a wire break, and then through an eyelet 54 provided at the end of arm 55, before passing through the first wire guide 48 and then through the bore 49 in the spinner assembly 31. The arm 55 is mounted on the shaft of an electric motor across the terminals of which a voltage is impressed, such that the motor is in a stalled condition but exerts a bias on the arm to urge the eyelet 54 away from the first wire guide 48 and provide a means to take up slack wire during the looping process. The motor shaft is also suitably coupled to the disc tensioners 53 so as automatically to adjust the drag imparted thereby on the wire 51, depending upon the proximity of the eyelet 54 to the first wire guide 48. In this way, a substantially uniform tension (or drag) can be imparted to the wire extending between the first guide 48 and the bore 49.

Figure 2B:
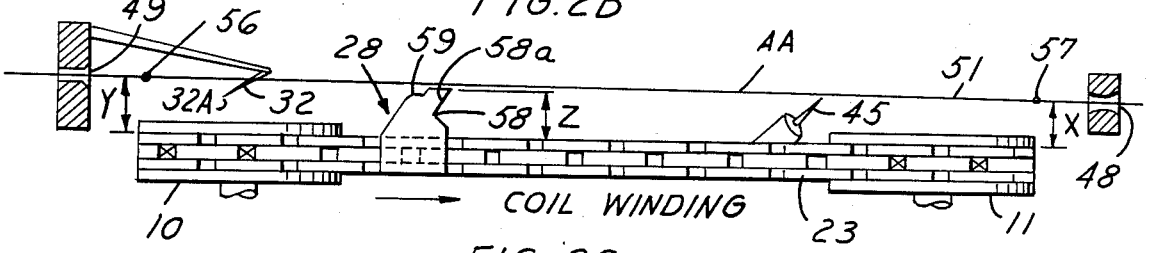

The apparatus described above is used to skein a wire in the following manner. The coil winding position of the apparatus is shown in FIGS. 2A and 2B and, when in this state, the wire 51 has a clear path between the first wire guide 49 and the second wire guide; the wire may thus easily be drawn through the apparatus for a coil winding operation, with constant tension maintained by the disc tensioners 53 controlled by the arm 55. Then, at the place in the wire where a skein is to be formed, drawing of the wire through the apparatus is stopped, the motor 19 is caused to run and the electromagnet 20 is energised so that drive is imparted to the sprocket 10 and hence to the chain 23. This causes the skeining finger 28 to move in an oval path defined by sprockets 10 and 11, describing a locus passing around the needles 32 and 45. As can be seen in FIG. 2B, axis of wire 51 when aligned between the first and second wire guide is inclined slightly relative to the plane defined by sprockets 10 and 11 or the path of finger 28. When viewing FIG. 2B the side elevation, i.e., along a plane parallel to sprockets 10 and 11, the finger has a height Z above chain 23. Finger-height Z is less than dimension Y, thereby allowing the finger to round sprocket 10 without intersecting the wire axis AA at a first point 56. Finger-height Z is greater than dimension X, causing the leading inclined edge of the finger to engage the wire at a second point 57 on wire axis AA. As can be seen in FIG. 2B, the height of second needle 45 is below wire guide axis AA. Furthermore, as can be seen in FIG. 2A in the top view, (i.e., looking along an axis generally perpendicular to the plane defined by sprockets 10 and 11) the second needle 45 is displaced laterally to one side of axis AA so that when finger 28 contacts the wire 51, the wire will be moved toward the second needle 45.

Figure 2C:
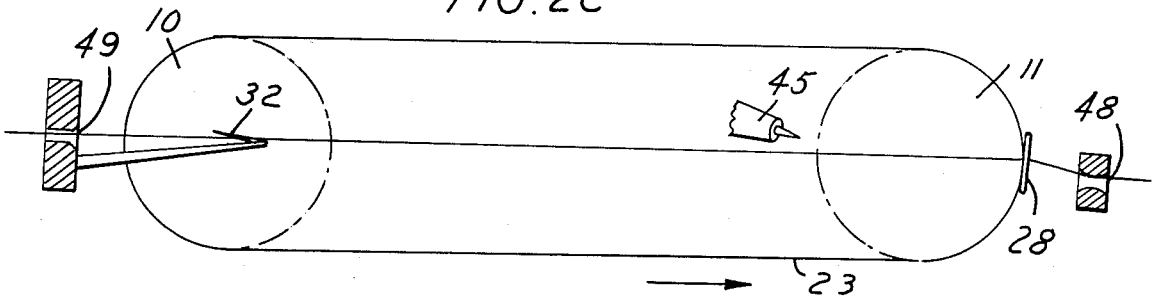
Figure 2D:
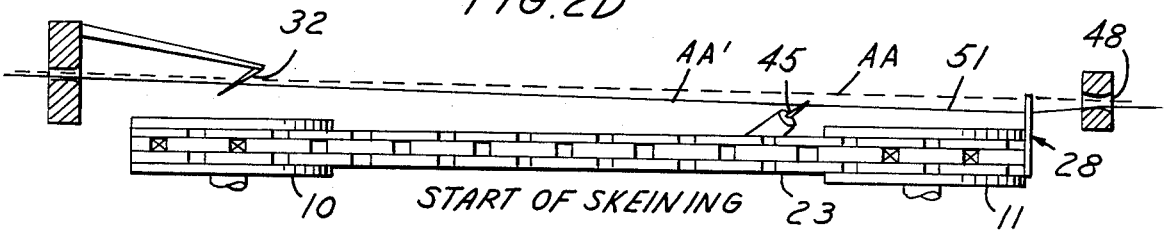
Figure 2E:
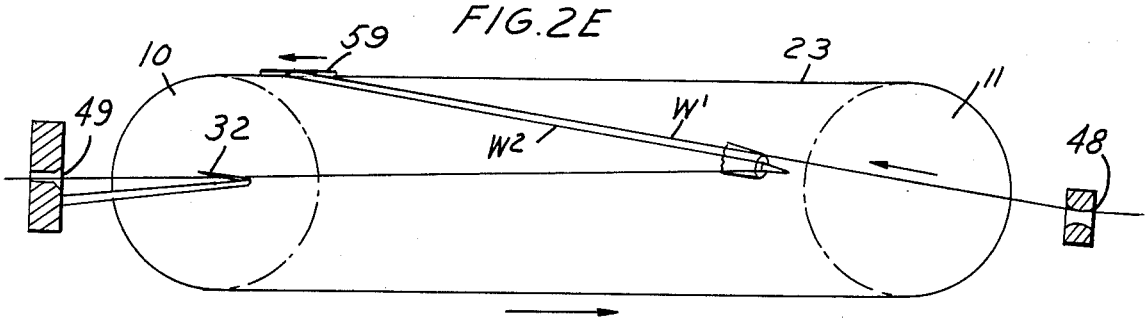
Figure 2F:
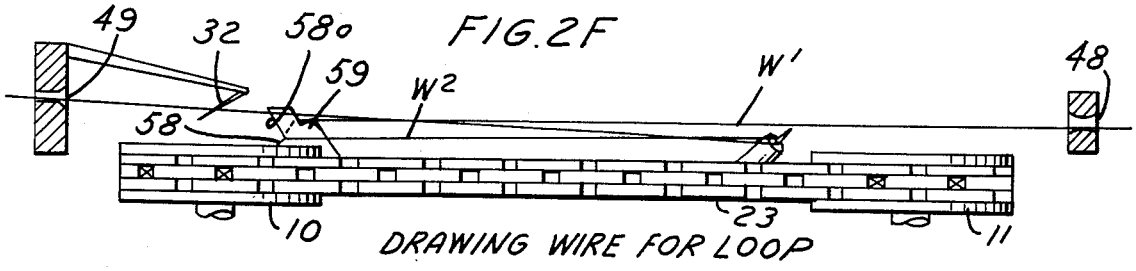
Figure 2G:
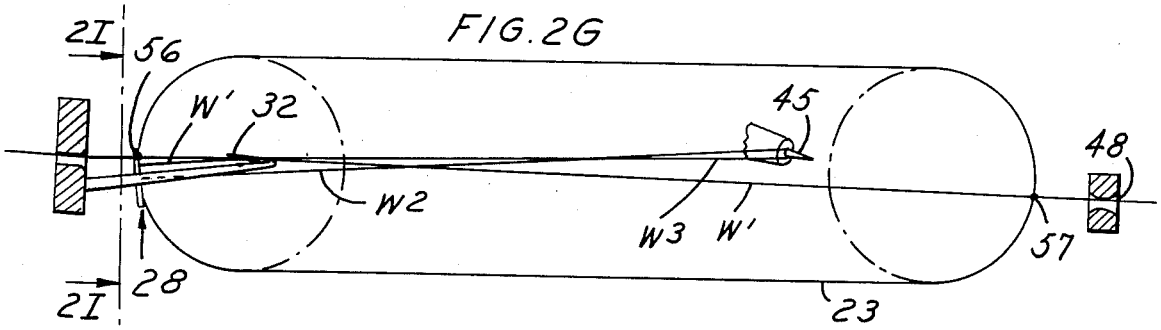
Figure 2H:
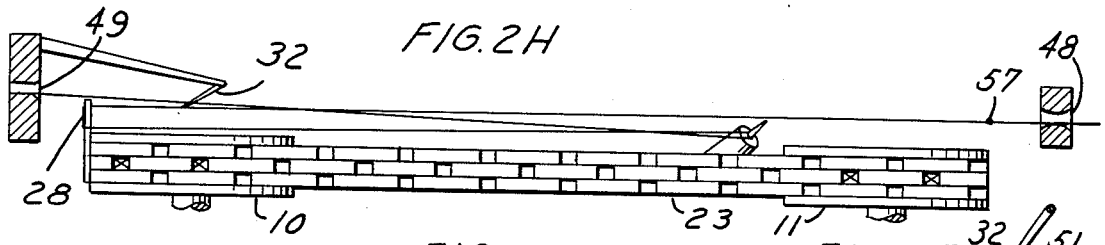
Figure 2J:
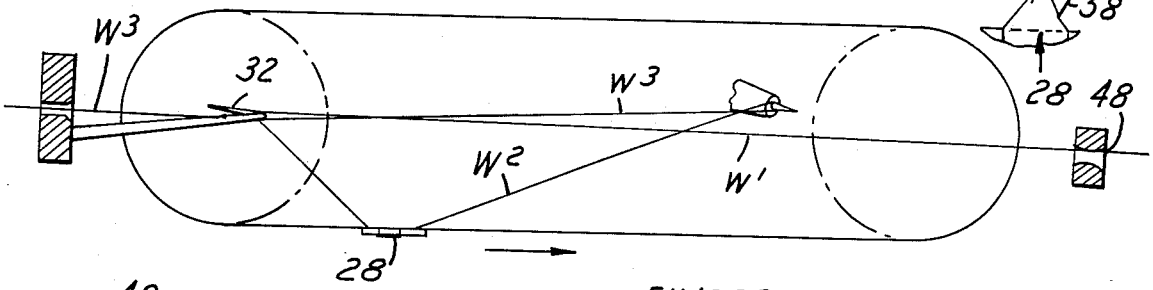
Figure 2I:
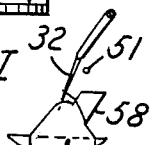
Figure 2K:
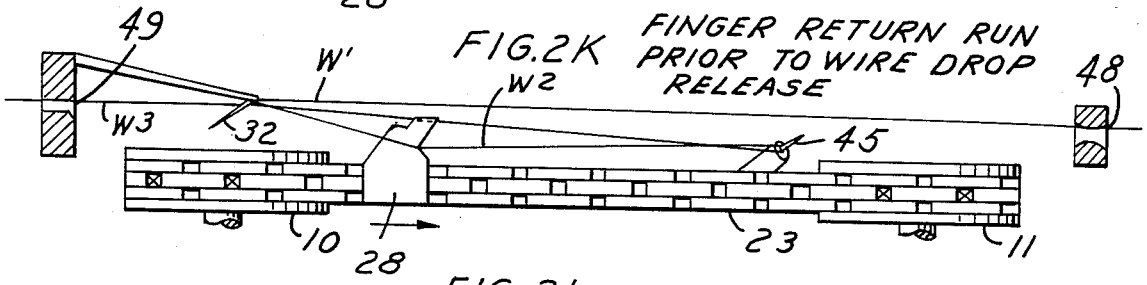
Figure 2L:
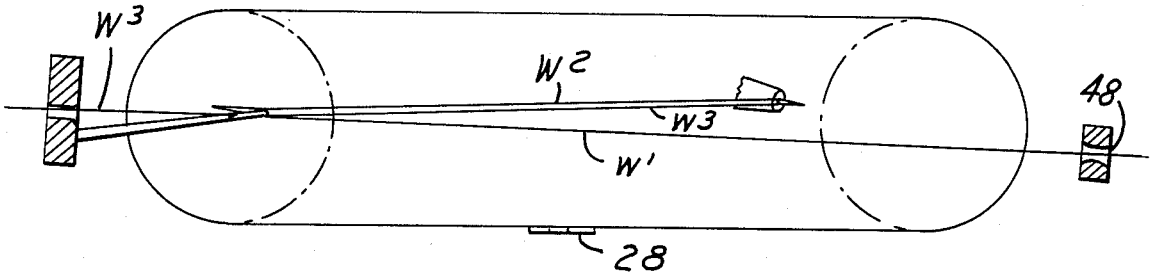
Figure 2M:
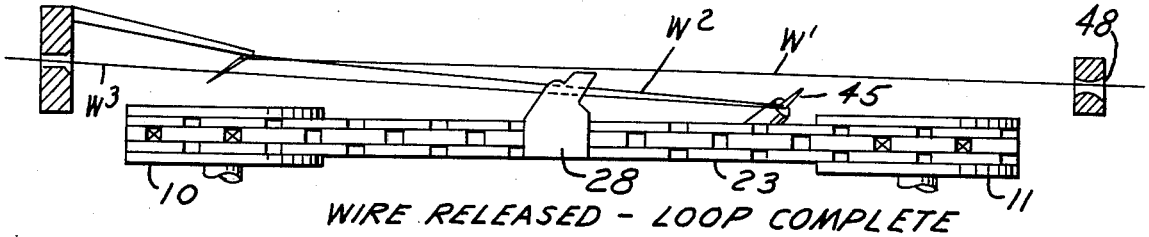

As can be seen in FIGS. 2A and 2B, finger 28 moves in an orbital path in the direction of arrow A. The leading edge of the finger is inclined as at 58*a* to slope from the free end of the finger away from the direction of travel and terminate in a leading or first finger shoulder 58 whose height is offset from or less than the height of the points of needles 32 or 45 as shown in FIG. 2B, so that the shoulder is in non-wrapping relation with needle 32 but in wrapping relation with needle 45 as hereinafter explained. The trailing edge of the finger is provided with a trailing or second finger shoulder 59 whose height is greater than the height of the points of needles 32 and 45 so that such trailing shoulder is in wrapping relation with needle 32 but not with needle 45 as hereinafter explained. As chain 23 is driven, the finger moves from sprocket 11 as shown in FIG. 2C. The leading edge 58*a* of the finger engages wire 51 which slides down the inclined edge 58*a* and rests in shoulder 58. When the wire is held in shoulder 58 it is biassed from axis AA toward the plane of sprockets 10 and 11 and assumes the general position AA′ so that wire 51 is below the point of the second needle 45 as can be seen in FIG. 2D. As the finger continues to advance along run 25 as shown in FIG. 2E, wire 51 is drawn through the guide 48 and begins to be wrapped about the needle 45. As the finger approaches sprocket 10, the portion $W^1$ of the wire extending from the finger 28 to second wire guide 48 will be held up in trailing finger shoulder 59 in a position to be wrapped around needle 32 as the finger rounds sprocket 10, while the wire $W^2$ extending from leading finger shoulder 58 to the needle 45 passes beneath the needle 32 without contact, as shown in FIGS. 2G and 2H. In addition, wire portion $W^1$ will pass just above the point of needle 45 so that such portion of the wire will not be wrapped thereon. Thus, as the finger passes by the point 56 as can be seen in FIGS. 2G–2I, the needle 32 hooks the wire $W^1$ extending from the trailing finger shoulder 59, but does not hook the wire $W^2$ extending from the leading finger shoulder 58 back to the second needle 45. As the finger continues to advance along run 24, as shown in FIGS. 2J and 2K, the portion $W^2$ of the wire pulled through the second guide means 48 is kept under tension by the wire tension means including arm 55 and eyelet 54. As the finger progresses along run 24, the wire at $W^2$ is released by the finger as shown in FIGS. 2L and 2M, the slack is withdrawn by the tensioner arm 55 and a loop is complete. Each complete revolution of the finger results in another loop being formed about the spinner needle 32 and the second needle 45. While only a single finger is shown attached to chain 23, it is possible to use as many as two fingers approximately equidistantly spaced on the endless chain 23 so that two loops are completed for each revolution of the chain.

Figure 2N:
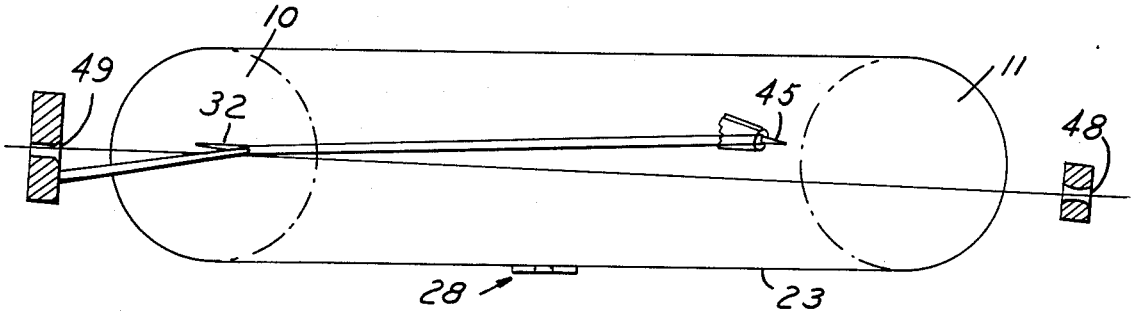
Figure 2O:
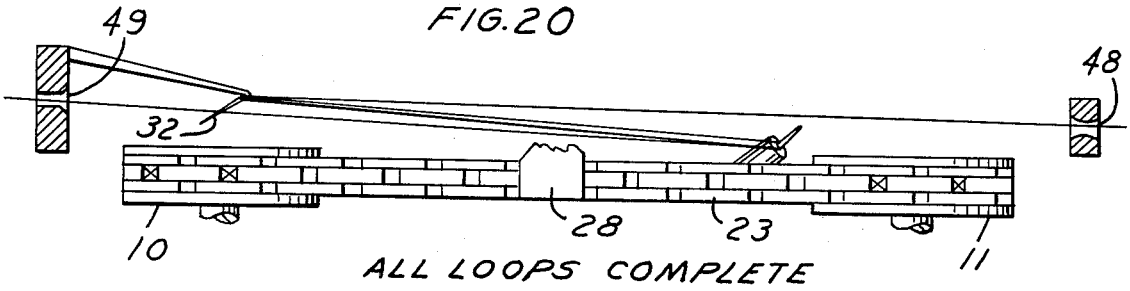
Figure 2P:
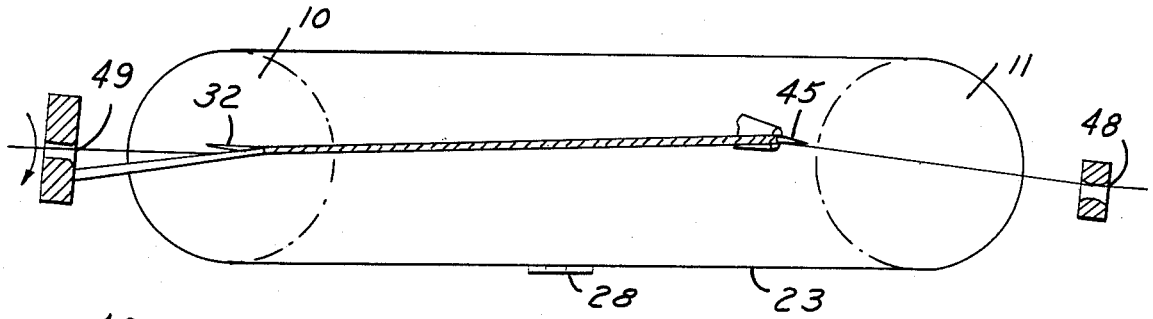
Figure 2Q:
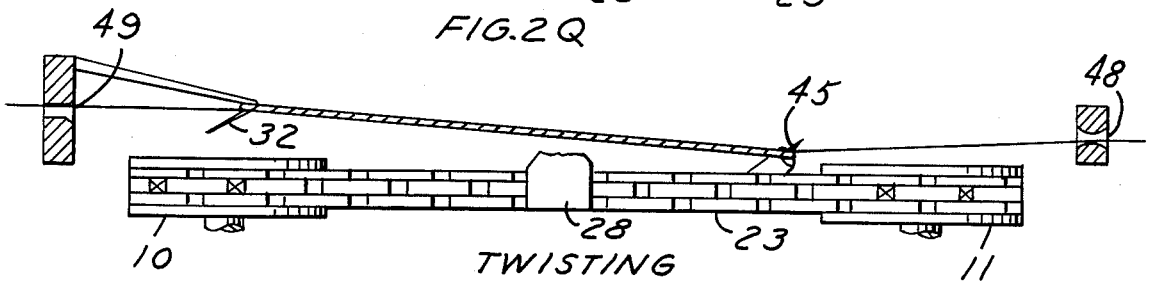

When as many loops as are desired have been completed, for example, as shown in FIGS. 2N and 20, the chain 23 stops. The spinner assembly 31 then begins to rotate as shown in FIGS. 2P and 2Q. The rotation of spinner assembly 31 and spinner needle 32 causes the loops formed about the two needles to be twisted into a skein. Twisting of the loops causes them to shorten and means must be provided to allow the two needles to move relative to one another to prevent the skein from breaking Referring to the embodiment apparatus shown in FIG. 1, the number of loops formed around the two needles can be monitored by the output of sensing element 30 co-operating with peg 29. Immediately after the element 30 provides an output indicative of the required number of loops, the electromagnet 20 is de-energised and the pawl 21 co-operates with the dog 22 to stop further rotation of the sprocket 10; by de-energising the electromagnet 20 in assocation with an output from the element 30, the movement of the looping element 26 will always be arrested at the same location.

Next, the electromagnet 37 is energised so as to allow drive to be imparted to the body 33 of the spinner assembly 31. This causes the spinner needle 32 to be rotated about the axis of the body 33, and thus the loops formed between the needle 32 and 45 are twisted along their lengths, to form the skein. This action shortens the effective length of the loops and the shortening is accommodated by pivotal movement of the carrier 46 of the second needle assembly, against the spring bias applied thereto. The number of turns performed by the spinner body 31 is counted by monitoring the output of the sensing element 43 co-operating with the peg 42, so that the loops can be twisted a predetermined number of times. Then when the required number of twists have been formed, electromagnet 37 is de-energised, arresting rotation of the body 33 and a mechanism (not shown) pivots the carrier 46 back towards the sprocket 10 against the spring bias to allow the skein to drop off the second needle 45 as the wire is drawn to the left as viewed in FIG. 1 towards the partly formed coil (not shown); this also pulls the skein off the first needle 32, and the skein is drawn through the first wire guide 49 with the wire.

An alternative to counting turns of the spinner body is to rotate the spinner body until the shortening of the loops pivots the carrier to such an extent that the second needle 45 is inclined towards the sprocket 10 allowing the skeined loops to slide off the needle 45. This method is not however preferred, even though it eliminates the need to provide the mechanism to pivot the carrier, because the skein tends to flail about on release from the second needle until the spinner is stopped, and this can lead to breakage of the formed skein.

Figure 3:
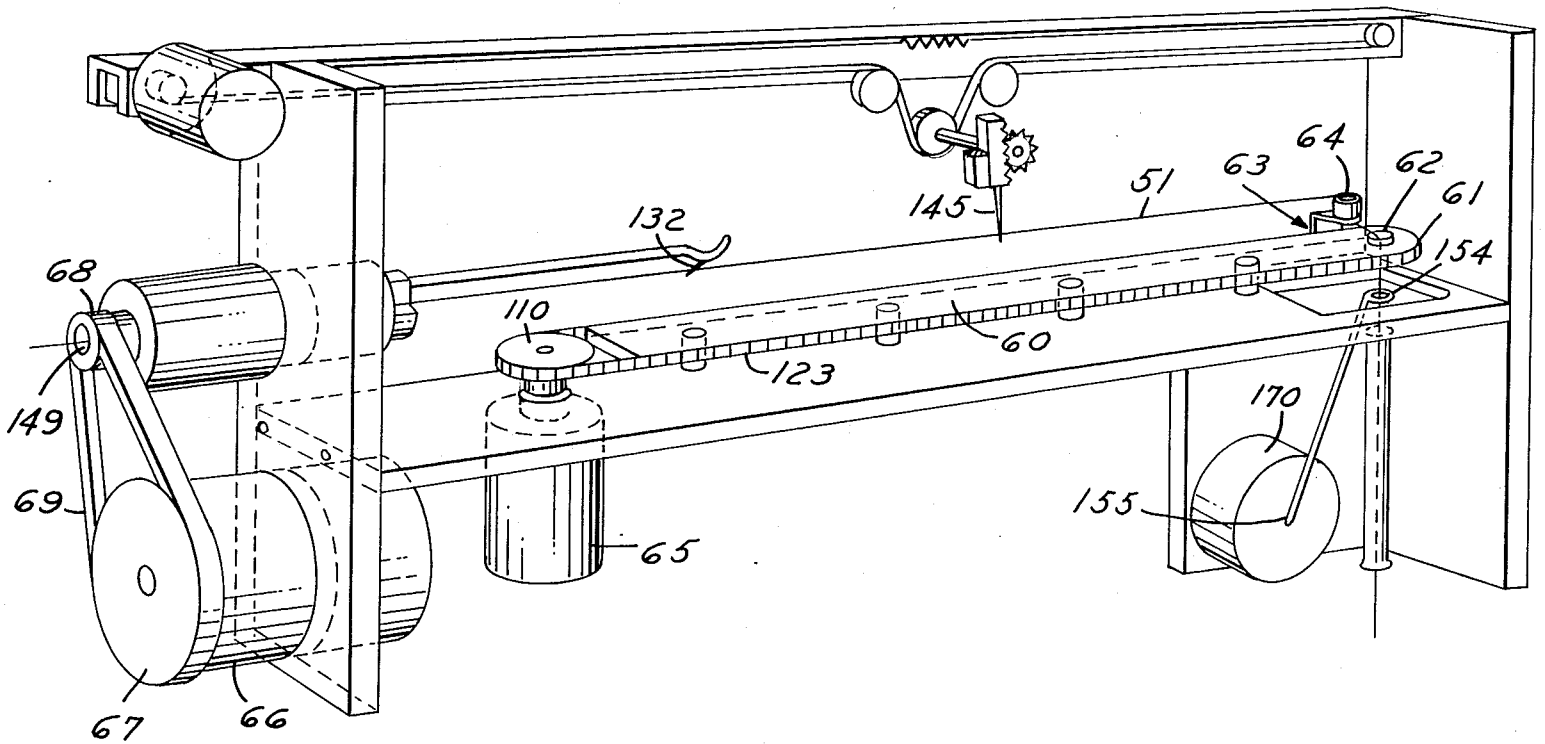
FIG. 3 is a diagrammatic general perspective view of a second embodiment of the skeining apparatus, incorporating an eyelet-looping element.

FIG. 3 shows a second embodiment of skeining apparatus of this invention which apparatus is of somewhat similar form to the first embodiment described above; like parts or parts performing an essentially similar function are given like, but 100 series, reference characters and will not be described again here.

In this second embodiment, the sprocket 11 is replaced by a flat guide plate 60 having at its end 61 remote from the sprocket 110 an arcuate surface around which the chain 123 may run. At the center of curvature of this arcuate surface, there is provided an aperture having fitted therein a bell-shaped wire guide 62 of a hard material. The chain 123 carries a looping element 63 in the form of an angle bracket on which is mounted a ceramic ring 64, the axis of the ring being substantially parallel to the axis of the sprocket 10.

Rather than using a single motor and spring clutches to power the spinner assembly and drive for the looping element, the embodiment of the invention shown in FIG. 3 uses separate motors. Looping-element motor 65 drives sprocket 10 and chain 123 which supports the looping element. Spinner motor 66 has drive pulley 67 connected to its output shaft. The drive pulley is preferably connected to the spinner pulley 68 using a cogged belt 69. It has been found that a six-to-one ratio of drive pulley circumference to spinner pulley circumference provides satisfactory performance. Spinner motor 66 is fabricated such that when not running, the armature will come to rest at one of six equally-space angular positions. The motor 66 may be of the type shown in U.S. Pat. No. 4,393,344. As a result of the six-to-one drive ratio, whenever the motor stops, spinner needle 132 will stop in the same orientation.

Figure 5A:
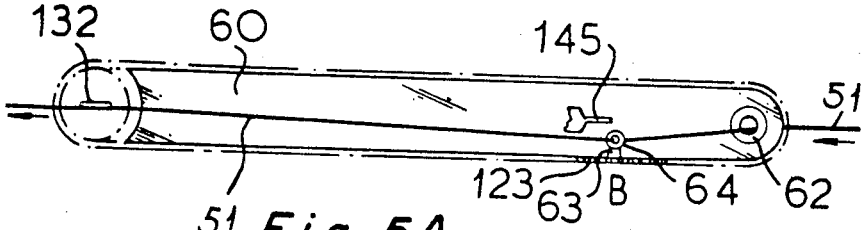
FIGS. 5A–5F are top elevations showing the relationship between the eyelet-type looping element, the two pins, and the wire at various stages of operation.
Figure 5B:
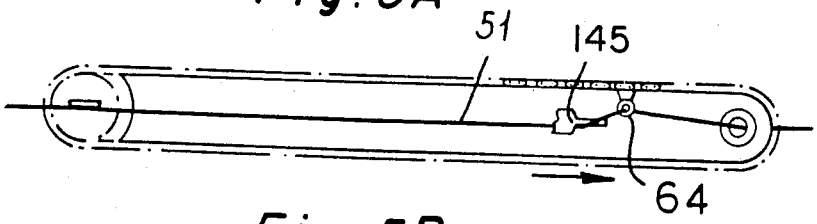
Figure 5C:
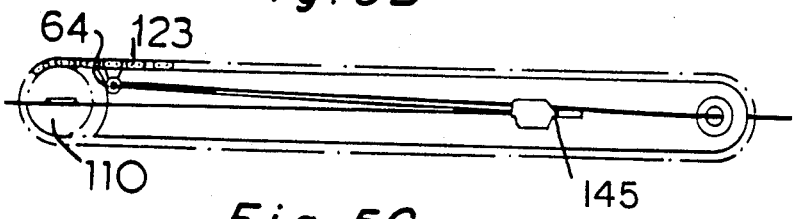
Figure 5D:
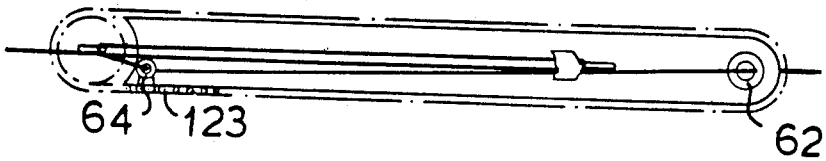
Figure 5E:
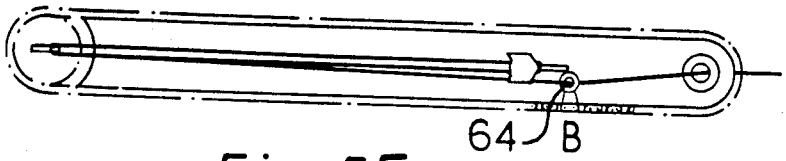
Figure 5F:
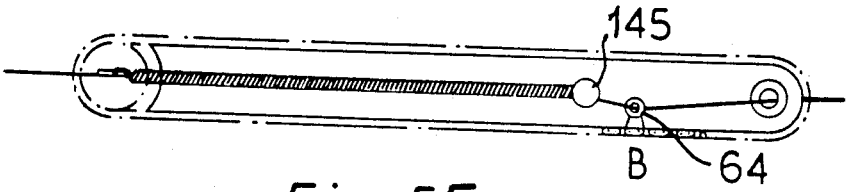

In this second embodiment of the invention, both the spinner needle and the second needle 145 are located above wire 51 and project downwardly. (The apparatus could obviously be oriented differently and the term downward is merely with reference to FIG. 3) Spinner needle 132 and second needle 145 extend toward guide plate 60 and terminate at a point which is below the level of wire 51 extending between eyelet 64 and spinner element 149 but do not project close enough to guide plate 60 so that the portion of the wire extending between wire guide 62 and the bottom of ring 64 attached to the looping element will engage the needles. In this second embodiment of the invention it is desirable to have the wire extending through eyelet 64, preferably a ceramic ring, to the spinner assembly 149, parallel to the path of the chain 23 (note in contrast the embodiment of the invention shown in FIG. 1 has the wire axis AA line slightly inclined relative to the path of the chain). After the proper amount of wire has been wrapped around the coil and the skeining operation is to begin, motor 65 is energized and looping element 63 attached to chain is driven about a path defined by guide plate 60 and sprocket 10. With each revolution a loop of wire is formed about spinner needle 132 and second needle 145 by eyelet 64. During each rotation, as the eyelet rounds sprocket 10 and returns toward guide plate end 61, the wire will tend to go slack and motor 170 to which is attached arm 155 and eye 154 will rotate sufficiently to take up the slack and main tension on the wire. After the proper number of loops have been completed, looping element motor 65 stops leaving the looping element (eyelet) near point B shown in FIG. 5E. The spinner motor 66 is now energized causing spinner needle 132 to rotate, twisting the loops into a skein as shown in FIG. 5F.

The sequence of operation of the embodiment of the invention shown in FIG. 3 can be best described with reference to FIGS. 5A through 5F. In FIG. 5A, wire 51 freely passes through the wire guide 62, through the eyelet 64 of looping element 63, past the second needle 145 and spinner needle 132 and through spinner assembly 149 to the coil winding apparatus (not shown). When coil winding is complete, chain 123 is driven in a counterclockwise direction as shown in FIG. 5B. Wire 51 is caught by second needle 145 as shown in FIGS. 5B and C. As the looping element rounds sprocket 10 in FIG. 5D, the wire extending from the top of eyelet 64 is wrapped about spinner pin 32. Note that the wire extending from wire guide 62 to the bottom of eyelet 64 is below the level of both the spinner pin and the second pin and therefore passes freely below as shown in FIGS. 5C and 5D without becoming entangled. As eyelet 64 again reaches point B in FIG. 5E, a loop is completed and the process may be repeated until the desired number of loops have been formed about the needle. With loops completed, the looping element comes to rest at point B and the spinner needle is rotated to form a skein as shown in FIG. 5F. As the skein is formed, twisting causes the wire looped about the pins to shorten and means must be provided to accommodate such.

Figure 4A:
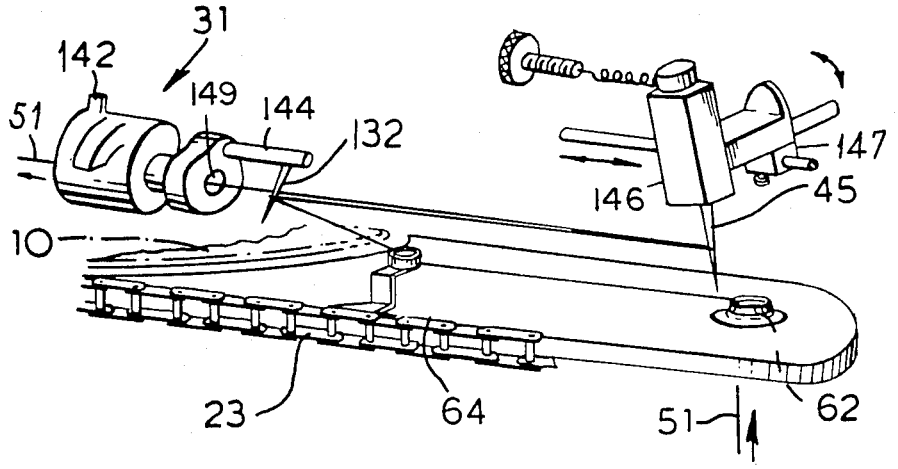
FIGS. 4A–4C are enlarged perspective views of three alternative embodiments of the second pin and support mechanism.
Figure 4B:
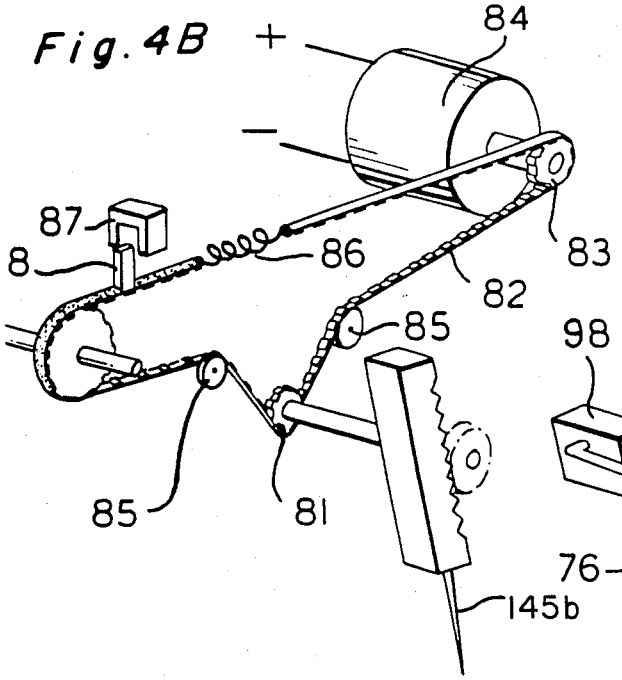
Figure 4C:
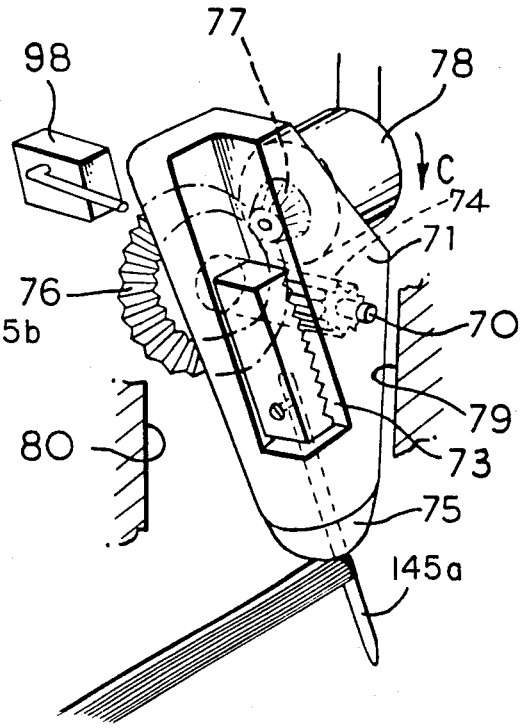

Three alternative second pin support mechanisms are shown in FIGS. 4A through C. The second needle assembly is positioned above chain 123 by rotatable carrier 146 pivotally mounted to support body 147. Support body 147 may be positioned with respect to the spinner needle 132 so that any desired length skein may be produced. Second needle 145 is normally held in the position shown inclined slightly toward bar guide 62 so as to retain a loop formed by the two needles. As the loops shorten when they are twisted into a skein, needle 145 and carrier 146 rotate relative to support body 147 as the bias spring load is overcome. With the twisting operation completed, coil winding resumes and the wire is pulled through bore 149. The load on the wire caused by coil winding causes second needle carrier 146 to rotate sufficiently so that the needle is inclined toward the spinner assembly and the skein then slides free. The skein also slides free of spinner needle 132 which is already inclined toward 149. While the second needle support apparatus shown in FIG. 4A is quite simple, on occasion with fine wire, breakage occurs when the skein prematurely slips the second needle or prior to the second needle rotating sufficiently for the skein to slide off. To overcome these problems, the needle support system shown in detail in FIGS. 4B and 4C has been developed.

In FIG. 4C a shaft 70 is rotatably mounted in the frame of the apparatus and pivotally supports a carrier 71 for the second needle 145*a*. A toothed rack 73 is slidably mounted within the carrier 71, and is disposed so that its teeth mesh with a pinion 74 fixed to the shaft 70 within the carrier 71. The carrier has a needle guide portion 75 from which the needle 72 projects, allowing the needle to be supported and yet able to be withdrawn into the carrier upon rotation of the pinion 74 in the appropriate sense.

Also attached to the shaft 70, but outside the carrier 71, is a bevel gear 76, meshing with a pinion 77 provided on the shaft of a direct current electric motor 78. Impressing a voltage across the electric motor terminals with such a polarity that the motor exerts a torque in the direction of arrow C will rotate the bevel gear 76 until the needle 145*a* has projected to its fullest possible extend, and thereafter will drive the carrier 71 into engagement with a stop 79; thereafter, maintaining a voltage across the terminals of the motor when in a stalled condition will impart a bias on the carrier, to urge the needle 145*a* away from the needle 132. Detection of the carrier 71 at this position is performed by switch 98, as in the embodiment of FIG. 4C. After the loops have been formed around the two skeining needles, they are twisted along their length, and during this twisting, carrier 71 may pivot about the shaft 70, against the bias provided by the stalled motor 78. However, once the required number of twists have been formed in the loops, then the polarity applied to the motor 78 may be reversed, so that the motor will run firstly pivoting the carrier 71 until it strikes a second stop 80 and thereafter withdrawing the needle 145*a* into the carrier 71, to drop the skein from the needle.

FIG. 4B shows an enlarged view of another alternative for the second needle apparatus depicted in FIG. 3. It is generally similar to the apparatus of FIG. 4C, however, bevel gear 76 is replaced by a toothed pulley 81, and is driven by a toothed belt 82 passing partially therearound and partially around a motor pulley 83 provided on the output shaft of a direct current electric driving motor 84. The belt is constrained by idler pulleys 85 and the two ends of the belt are coupled together by means of a spring 86 adapted to maintain the correct tension in the belt. An optical or inductive slotted detector 87 is co-operable with a peg 88 provided on the belt to allow detection of the 'home' position of the needle 145*b*.

The arrangement of FIG. 4B operates in exactly the same manner as that of FIG. 4C, but has the advantage that the motor 84 may be positioned at some distance from the needle assembly itself, for space in the region where the needle assembly has to be located may be somewhat restricted.

Figure 6:
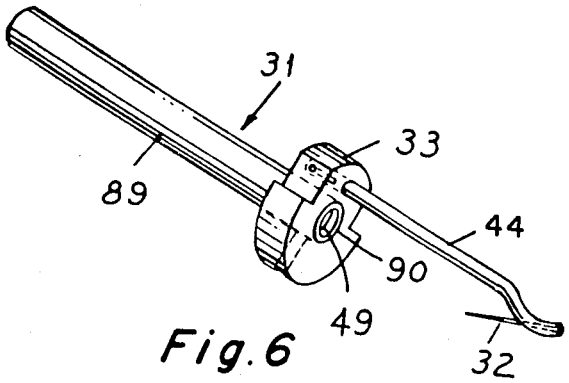
FIG. 6 is an enlarged perspective view of the first pin and spinner assembly.

FIG. 6 shows an enlarged view of spinner assembly 31 which may be used with either the FIGS. 1 or 3 embodiments. Tube 89 is provided with a bore 49 through which the wire (not shown) may pass. One one end of the tube a flange member 33 is mounted and on the other end the spinner pulley 68 (not shown) is mounted as in FIG. 3. The tube is supported so that it may be freely rotated by conventional bushing or bearing means. A needle supporting arm 44 is attached to flange 33 and supports spinner needle 32. The tube is preferably fitted with a ceramic wire guide 90 as shown to minimize wear. Spinner needle 32 is spaced from wire guide 90 by arm 44 and is inclined generally toward the wire guide to allow the completed skein to be pulled therefrom.

Figure 7A:
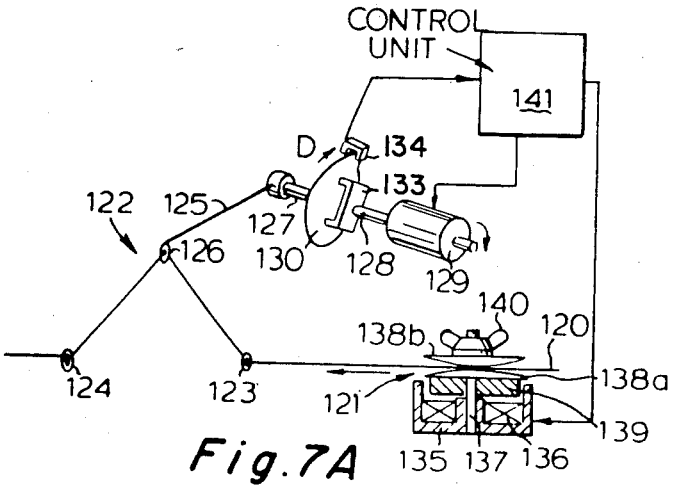
FIGS. 7A–7C show a wire tension control apparatus with alternative devices for detecting wire tension.
Figure 7B:
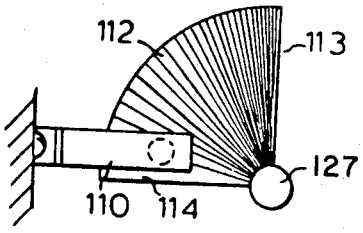
Figure 7C:
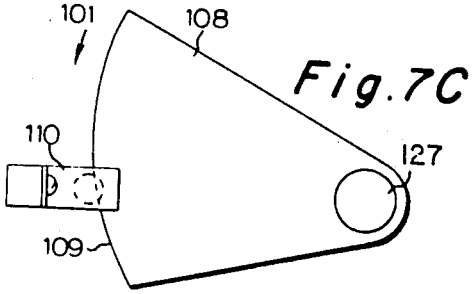

FIGS. 7A–C illustrate an automatic tension controlling device which may replace that shown in FIG. 1, or which may be used in conjunction with the apparatus of FIG. 3.

FIG. 7A shows a closed loop automatic tensioning device which again may replace that shown in FIG. 1, or may be used other than in conjunction with skeining apparatus. Wire 120 is drawn from a spool (not shown) through a disc tensioner 121 (though in practice a series of such tensioners would ordinarily be provided), and then through a tension detecting arrangement 122, including an inlet guide 123, an outlet guide 124 and an arm 125 with an eyelet 126 at its free end, the arm being mounted on a shaft 127. The tension detecting arrangement 122 also serves as a means to take up the slack wire during portions of the looping process. A spring (not shown) such as a hair spring or a torsion spring may be provided to apply a torque to the shaft 127 in the direction of arrow D. The shaft 127 is coupled to the shaft 128 of an electric motor 129 by means of an eddy-current coupling, comprising an aluminium disc 130 affixed to shaft 127 and closely associated with a permanent magnet 133 affixed to the motor shaft 128. The edge of the disc 130 is given a ramp profile for co-operation with a slotted optical transmitter/receiver pair 134, such that an output can be obtained from device 134 indicative of the instantaneous angular position of the arm 125.

The disc tensioner 121, which serves as a wire brake, comprises a bobbin 135 formed of a ferrous material, preferably soft iron, defining an annular channel-shaped coil-receiving section, in which is provided an electromagnet coil 136. The bobbin supports a non-magnetic spindle 137 co-axial therewith, on which is slidably mounted a pair of hard tensioner discs 138*a* and 138*b*, the lower disc 138*a* having affixed thereto a permanent magnet 139 magnetised so that its central region is one pole and its peripheral region is the other pole. Alternatively, the magnet 139 could be magnetised with one face one pole and the other face the other pole, and the electromagnet would have to be energised accordingly. The free end portion of the spindle 137 is screw-threaded and carries a threaded adjuster 140 associated with the upper disc 138*b*.

An electronic control unit 141 receives the output from the optical device 132 and also provides the drive for the coil 136 of the tensioner 121. An adjustable drive unit is provided for the motor 129, allowing selection of a particular rotational rate, and hence of a desired tension.

In use the required tension is set by adjusting the speed of the motor 129, so as to apply an appropriate force through the eddy-current coupling to the arm 125. Dependent upon the speed at which the wire is drawn through the device, the arm takes up a particular attitude which is detected by the optical transmitter/-receiver pair 134 and the ouptut therefrom is fed to the control unit 141. This provides a drive to the coil 136 so as to repel the permanent magnet 139 with a force appropriate to set the required tension. It will be appreciated that when no drive is given to the coil 136, the permanent magnet 139 is attracted to the bobbin 135, thus releasing the tension, and the greater the drive to the coil, the greater the applied tension.

FIGS. 7B and 7C show an alternative form of optical detector, to replace that shown in FIG. 7A. In the 7B arrangement, a disc 112 made of transparent material is affixed to the motor shaft 127, the disc having radial opaque lines formed thereon. The spacing between the radial lines is very close in the first region 113, but is relatively wide in an second region 114. Consequently, the attenuation of the radiation emitted by the transmitter and received by the receiver of the optical transmitter/receiver pair 110 will depend upon the instantaneous angular position of the disc 112. The 7C embodiment is similar to that shown in 7A using an opaque disc 108 fixed to shaft 127. The disc shown in 7C has a ramp 109 form at its edge to cause the slotted optical transmitter 110 to vary from zero to 100% transmittance in approximately 30 degree of rotation of shaft 127.

Figure 8:
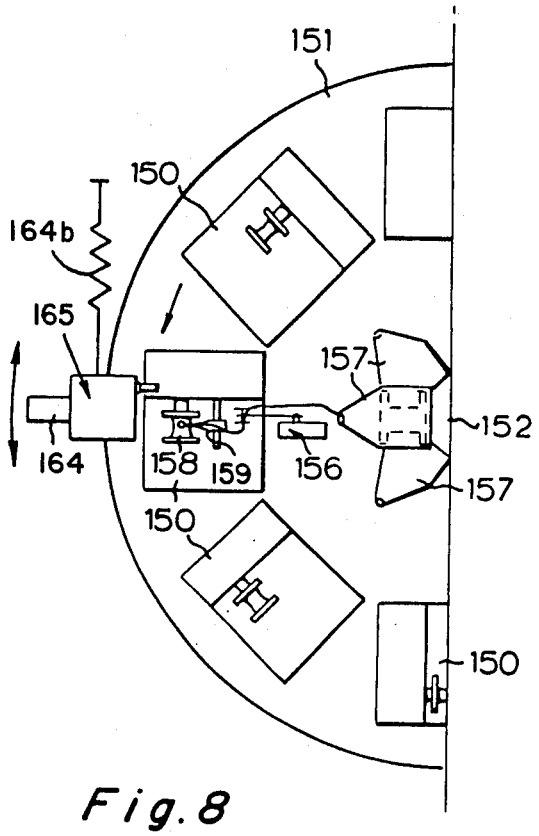
FIG. 8 is a side elevation of a finger-type skeining apparatus used in conjunction with a multi-station coil-winding machine.
Figure 9:
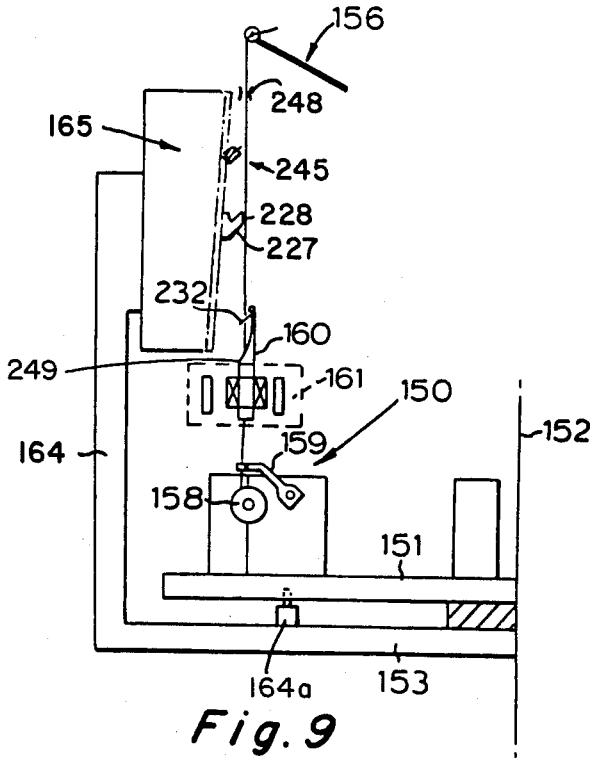
FIG. 9 is a top view of the skeining machine shown in FIG. 8.

Referring now to FIGS. 8 and 9, there is illustrated part of a coil-winding installation having a plurality of coil-winding mechanisms 150 mounted on a carousel 151 (or turntable) adapted for rotation about a vertical axis 152, either continuously or in a series of steps. Each coil-winding mechanism 150 passes through a series of stations at each of which a particular operation is performed—for instance, loading of fresh bobbin, starting the winding of a coil, completing the winding of a coil, and so on. Such a carousel-type of coil-winding installation is known in the art and will not be described in greater detail here.

So far as is possible in the following description, the same reference characters will be used to describe like parts as have been used when describing parts illustrated in FIGS. 1 to 7, except they are of a 200 series.

The carousel-type of coil-winding installation illustrated in FIGS. 8 and 9 has been modified to allow the skeining of the wire being wound, at least at the beginning and end of each coil but also if necessary part way through the winding of the coil to allow the production of a tapped coil. A carrier 153 is pivotally mounted below and about the same axis 152 as the carousel turntable 151 and includes an arm 164 which upstands radially beyond the periphery of the turntable. Mounted on this arm 164 is a looping mechanism 165 including a pair of sprockets (not shown) spaced vertically with their axes horizontal and parallel, a chain (also not shown) passing round the two sprockets such that its two runs extend slightly inclined to the vertical, a skein looping element 227 including a finger 228 projecting therefrom being mounted on the chain and there being an appropriate electric motor drive arrangement (not shown) for the sprockets and chain. Means (164*a*) are provided to effect swinging movment of this looping mechanism with the carousel about the axis 152 of the carousel turntable, so that the looping mechanism may remain in register with one of the coil-winding mechanisms 150 on the carousel for a predetermined arc of movement of the turntable. Means 164*a* may be any suitable device such as, for example, a solenoid operated locking pin which engages in the turntable to cause the turntable and carrier 153 to move together, and then withdraws to allow a spring return 164*b* to return the carrier to its starting position to repeat the cycle.

Each coil-winding mechanism 150 mounted on the carousel is arranged to have a first wire guide 248, a spinner assembly including a spinner needle 232 spaced vertically below the first guide 248, and a wire tensioning means 156 provided above the first guide. For each coil-winding mechanism, wire is drawn by a conventional de-reeler from a spool 157 mounted centrally of the carousel turntable so as to pass through the wire tensioning means 156 into the first guide 248, and from there to extend vertically downwardly past a second skeining needle 245 on the looping mechanism 165 and then to the spinner assembly including the spinner needle 232. The spinner assembly includes a wire guide 249 similar to that of FIGS. 2A and 2B to define a wire axis with guide 248. The wire passes through the spinner 160 itself and then is guided to the bobbin 158 on which the coil is to be wound, by means of conventional winding and layering equipment 159. Each time a skein is to be formed in the wire, the turntable 151 and looping mechanism 165 are caused to be juxtaposed whereupon the electric motor of the looping mechanism is energised to cause the finger 228 to describe a locus around the two skeining needles 232 and 245, forming loops of the wire around those needles. If the turntable 151 is advanced during this, then so also should be the looping mechanism 165, at the same rate. When a sufficient number of loops have been formed around the needles, the motor of the looping mechanism is de-energised when the finger 228 is disposed at such a position that the wire is disengaged therefrom. Thereafter, the spinner 160 is rotated by an associated positioning motor 161 to form a skein from the loops in a manner such as has been described above with reference for example to FIGS. 1 and 2A–2Q.

It will be appreciated that in the above described carousel-type of coil-winding installation, considerable economies of equipment can be made because only one looping mechanism 165 need be provided and the modification of each (conventional) coil-winding assembly as ordinarily may be provided on a carousel-type coil-winder is relatively slight. Despite this, by incorporating various of the preferred features of the embodiments of skein forming apparatus as have been described above with reference to FIGS. 1 to 12, it is possible reliably and quickly to form skeins for incorporation in a coil, without significantly affecting the speed of the overall coil-winding operation.

I claim:

1. A skeining apparatus comprising, in combination: a pair of spaced apart filament guides arranged beyond opposite ends of a skein to be formed;

a pair of spaced apart looping needles arranged between the guides with one needle being revolvable to twist filament strands looped over the needles into a skein;

an endless drive member carrying a looping element with the drive member constrained to follow a path such that the locus of the element encircles both needles and with the needles intersecting a plane defined by the locus of the looping element; and means for propelling the drive member and the revolvable needle and operable to stop each of them with the looping element and revolvable needle in predetermined positions.

2. The invention defined by claim 1 wherein said means includes a squirrel cage motor stopping at predetermined positions of rotation.

3. The invention defined by claim 1 wherein said looping element comprises an eyelet through which the filament to be skeined is threaded and one of said filament guides is disposed within the locus of movement of the eyelet to feed filament to the eyelet.

4. The invention defined by claim 1 wherein the looping element comprises a finger upstanding from the endless drive member and arranged to bypass a filament extending between the guides during a portion of its movement around the needles but intersect the filament to form a loop therein during another portion of its movement.

5. The invention defined by claim 4 wherein said finger bypasses the filament during its movement around the revolvable needle but intersects the filament during its movement around the other needle.

6. The invention defined by claim 5 wherein means are provided on the looping finger for transferring a loop of a filament caught on the finger to the revolvable needle as the finger moves around it.

7. The invention of claim 1 further comprising means for maintaining tension on the wire during the skein forming process.

8. The invention of claim 7 wherein said means for maintaining tension on the wire during skeining is further comprised of means to take up the slack wire during the looping process and wire brake means.

9. The invention of claim 1 further comprised of means for decreasing the distance between the first and the second needle so that as the loops formed thereabout are twisted into a skein the resulting shortening of the loops does not cause the wire to break.

10. A skeining apparatus comprising, in combination:

a pair of spaced apart filament guides establishing a filament axis therebetween;

first and second spaced apart looping needles disposed between the guides and generally along said filament axis, with the first needle being revolvable substantially about the filament axis;

a filament looping finger movable in a locus around the needles and following a path offset from the filament axis to bypass the filament as the finger passes the first needle but overlap the filament axis to intersect the filament as the finger passes the second needle; and means for transferring a filament loop caught on the finger to the first needle as the finger passes it.

11. The invention defined by claim 10 wherein said needles extend in opposite directions relative to the filament axis and slope generally toward the adjacent filament guide.

12. The invention defined by claim 10 wherein the first needle extends across the filament axis and the second needle is offset from and does not cross the filament axis.

13. The invention defined by claim 10 wherein said means for transferring a filament loop is on said finger.

14. The invention defined by claim 13 wherein said means comprises a leading edge on the finger sloping from the free end of the finger away from the direction of travel to a first shoulder offset from the free end of the first needle in non-wrapping relation therewith, and a trailing edge sloping from the free end of the finger to a second shoulder overlapping the first needle in filament wrapping relation therewith, and said first shoulder overlapping the second needle in filament wrapping relation therewith.

15. The invention defined by claim 10 wherein said locus of the filament looping finger defines a plane inclined to the filament axis.

16. A skeining machine for wire and the like, comprising in combination:

a first and second wire guides spaced apart to support a wire along an axis therebetween;

a finger having a free end movable along a closed loop path to pass adjacent the axis and between said wire guides without intersection at a first point and to intersect said axis at a second point, said finger having an inclined edge having a first shoulder on the leading surface and a second shoulder on the trailing surface;

a first needle having a free end inclined toward the first point positioned between the first and second point and passing adjacent said axis, and rotatable about the same;

a second needle having a free end spaced between the first needle and the second point on the axis, and inclined toward the second point;

means for advancing the finger in a closed loop path so that the inclined leading surface of the finger contacts the wire at the second point and biases it from the axis an amount sufficient so that the wire is wrapped about the second needle as the finger advances along the path, with the wire nested in the first shoulder of the finger, as the finger passes adjacent the first point the wire extending from the second needle to the first shoulder on the finger passes the first needle without contact, while the wire extending from the trailing surface of the needle nested in the second shoulder, to the wire guide means, is caught by the first needle but passes freely over the second needle, as the finger returns toward the second point the wire is dropped by the finger and a loop is completed; and means to rotate the first needle about said axis causing the wire loop between the first and second needle to be twisted into a skein.

17. The machine of claim 16 wherein the means for advancing the finger comprises a flexible loop held between two circular supports to define a generally oval path for the finger.

18. The machine of claim 16 wherein said second needle remote from the first needle is fixed against rotation about an axis parallel to or coincident with a line passing through the first and second wire guide means, but is mounted to allow movement thereof towards and away from said first needle.

19. The machine of claim 18 wherein the second needle is inclined away from said first needle to aid in the retention of the wire loops formed thereon.

20. The machine of claim 19 wherein each station of the coil winder is provided with a second needle.

21. The machine of claim 19 wherein said second needle is incorporated in said skeining attachment.

22. The machine of claim 19 further comprising a carrier to which the second needle is pivotably mounted to allow the needle to swing towards and away from the spinner needle, and biasing means to urge the free end of the second needle away from the first needle.

23. The machine of claim 22 wherein the biasing means includes an electric motor which is coupled to the second needle.

24. The machine of claim 18 wherein the second needle is mounted on a carrier in such a manner that the needle may be withdrawn into the carrier to permit the loops formed thereon to be dropped.

25. Apparatus according to claim 24, wherein there is provided a second needle assembly comprising a carrier pivotally mounted for swinging movement towards and away from the spinner needle, a needle mounted on a toothed rack slidably supported by the carrier for movement along its length between a first position in which the needle is housed within the carrier and a second position in which the needle projects for the carrier, the rack extending past the pivotal axis of the carrier and being engaged by a pinion rotatable about said axis, and an electric actuator provided on a fixed part of the apparatus and drivably connected to the pinion, the arrangement being such that torque exerted by the actuator in one sense causes the pinion to rotate to drive the rack to its second position and thereafter urges the carrier to swing about its pivotal axis in a direction which moves the projected needle away from the spinner needle, and torque exerted by the actuator in the other sense allows the carrier to swing towards the spinner needle and also withdraws the needle back into the carrier.

26. The skeining machine of claim 16 adapted for use on a multi-station coil winder wherein each station is provided with a first and second wire guide means, a first needle and means for rotation of the first needle, said finger and means for advancing same being located in a skeining attachment which intermittently cooperates with each station in order to form a skein.

27. A skeining apparatus for use with an indexable table having a plurality of coil winding machines thereon comprising, in combination:

for each coil winding machine on the table a pair of wire guides upstream of the coil winder portion of each such machine with the guides defining a wire axis;

a looping needle lying along the wire axis of each pair of guides and extending across the wire axis and revolvable therearound;

at a station adjacent the table to which each pair of wire guides and revolvable needles are indexed during coil winding, a wire looping needle spaced along the wire axis from the revolvable needle, a wire looping finger mounted for movement along an endless path whose locus encircles the needles with the finger having a free end projecting across the wire axis during a portion of finger travel and being spaced from the wire axis during another portion of finger travel, whereby in the second mentioned portion of travel the table may be indexed without interfering with the wire lying on the wire axis; and means for driving said finger along its aforesaid path to loop wire around the needles and stop travel of the finger when it lies spaced from the wire axis.

28. The invention defined by claim 27 wherein said station is supported for movement with the table during a portion of the angular movement thereof and means are provided for temporarily locking the station and table together.

* * * * *